US010959548B2

(12) United States Patent
Tak et al.

(10) Patent No.: US 10,959,548 B2
(45) Date of Patent: Mar. 30, 2021

(54) FITTED MATTRESS COVERING

(71) Applicant: Himatsingka Seide Limited, Bangalore (IN)

(72) Inventors: Rashpal Singh Tak, Amritsar (IN); Adnaan Zaheer, Bangalore (IN)

(73) Assignee: Himatsingka Seide Limited, Bangalore (IN)

( * ) Notice: Subject to any disclaimer, the term of this patent is extended or adjusted under 35 U.S.C. 154(b) by 0 days.

(21) Appl. No.: 16/888,843

(22) Filed: May 31, 2020

(65) Prior Publication Data

US 2020/0288889 A1 Sep. 17, 2020

Related U.S. Application Data

(63) Continuation-in-part of application No. 15/712,146, filed on Sep. 22, 2017, now abandoned.

(51) Int. Cl.

| | |
|---|---|
| ***A47G 9/02*** | (2006.01) |
| *A47C 31/08* | (2006.01) |
| *A47C 21/02* | (2006.01) |
| *A47C 31/10* | (2006.01) |

(52) U.S. Cl.

CPC ..... *A47G 9/0246* (2013.01); *A47C 21/022* (2013.01); *A47C 21/028* (2013.01); *A47C 31/08* (2013.01); *A47C 31/105* (2013.01); *A47G 2009/0269* (2013.01)

(58) Field of Classification Search

CPC ..... A47G 9/0246; A47G 9/04; A47G 2009/0269; A47C 21/022; A47C 21/028; A47C 31/08; A47C 31/105

See application file for complete search history.

(56) References Cited

U.S. PATENT DOCUMENTS 4,040,133 A * 8/1977 Gilreath ..... A47C 21/022 5/669
4,057,862 A * 11/1977 LaBianco ..... A47C 27/085 5/679
4,461,049 A 7/1984 Hammond
(Continued)

FOREIGN PATENT DOCUMENTS

CN 201968283 U 9/2011

OTHER PUBLICATIONS

4-Piece King Bed Sheet Set with Corner Straps on Extra Deep Pocket and Sleep Guide, White by Empyrean Bedding, 2017 https://www.amazon.com/Empyrean-Bedding-4-Piece-Corner-Straps/dp/B01EI6IMRE.

*Primary Examiner* — Robert G Santos
*Assistant Examiner* — Rahib T Zaman
(74) *Attorney, Agent, or Firm* — Chinta & Fratangelo LLP

(57) ABSTRACT

A fitted mattress cover is provided, having elastic elements at each corner which hold the cover in place. A corner elastic element runs along each corner seam, and is attached to the center of a diagonal elastic element. The diagonal elastic acts a lock system to prevent movement of the fitted sheet during any pull from the top of the fitted sheet. The corner elastic helps to hold the corner of the cover to the mattress, and also prevents peaking of the corner seam, leading to an improved appearance and helps to fit mattresses of different thickness. Elbow elastics at the corners, perpendicular to the corner elastics, hold the side panels tightly to the mattress and inhibit them from sliding upwards.

20 Claims, 13 Drawing Sheets

(56) References Cited

U.S. PATENT DOCUMENTS

| | | | | | |
|---|---|---|---|---|---|
| 4,624,022 | A * | 11/1986 | Dolan | A47C 21/022 | 24/72.5 |
| 4,662,013 | A * | 5/1987 | Harrison | A47G 9/0246 | 5/497 |
| 4,890,345 | A * | 1/1990 | Sessa | A47C 21/028 | 24/72.5 |
| 4,891,856 | A * | 1/1990 | Thornhill | A47C 21/022 | 5/496 |
| 5,029,353 | A | 7/1991 | Kimball et al. | | |
| 5,479,664 | A | 1/1996 | Hollander | | |
| 5,513,403 | A | 5/1996 | Wooten | | |
| 5,651,153 | A * | 7/1997 | Goodrich | A47C 21/022 | 24/72.5 |
| 6,161,235 | A * | 12/2000 | Smith | A47C 21/022 | 5/496 |
| 6,185,766 | B1 * | 2/2001 | Farrugia | A47C 21/022 | 24/72.5 |
| 6,983,500 | B2 | 1/2006 | Wootten | | |
| 7,316,039 | B2 * | 1/2008 | Wootten, Jr. | A47G 9/0246 | 5/497 |
| D627,184 | S | 11/2010 | Pisani et al. | | |
| D670,125 | S | 11/2012 | Agarwall | | |
| D677,964 | S | 3/2013 | Agarwall | | |
| 8,438,679 | B2 * | 5/2013 | Wootten, Jr. | A47G 9/0246 | 5/482 |
| D691,399 | S | 10/2013 | Jalan | | |
| 8,707,482 | B1 * | 4/2014 | Ramthun | A47G 9/0246 | 5/496 |
| D708,869 | S * | 7/2014 | Mun | D6/602 | |
| 8,856,984 | B1 * | 10/2014 | Donham | A47G 9/0246 | 5/496 |
| 8,898,834 | B1 | 12/2014 | Huber et al. | | |
| 9,259,107 | B2 | 2/2016 | Lilienthal | | |
| D759,904 | S | 6/2016 | Cantwell et al. | | |
| D773,859 | S | 12/2016 | Feldman | | |
| 2004/0040090 | A1 * | 3/2004 | Wootten | A47G 9/0246 | 5/497 |
| 2014/0317845 | A1 * | 10/2014 | Smith | A47G 9/0246 | 5/482 |

* cited by examiner

FITTED MATTRESS COVERING

CROSS-REFERENCE TO RELATED APPLICATIONS

This application is a Continuation-In-Part of U.S. patent application Ser. No. 15/712,146 filed on Sep. 22, 2017, now abandoned.

FIELD OF THE INVENTION

The present invention is in the field of bedding, and in particular to fitted coverings for mattresses.

BACKGROUND

Fitted coverings for mattresses, e.g., fitted sheets, mattress pads, blankets, and water- or allergen-proof covers, conventionally feature a planar upper portion which is sized to cover the top surface of the mattress, side and end portions which cover the sides and ends of the mattress, and a lower portion, usually formed by extending the side and end portions several inches beyond the bottom of the mattress, which covers only the periphery of the bottom surface of the mattress. The lower portion usually incorporates an elastic along the inner edge or the corners, which pulls the lower portion inward across the lower surface of the mattress, tightening the fitted covering around the mattress and fixing it in position. In order to better retain the cover on the mattress, diagonal elastic strips may be attached between the edges of adjacent side and end portions (see, e.g., U.S. Pat. Nos. 5,479,664, 5,513,403, 6,983,500 and 8,438,679).

The diagonal elastic strips, while serving to anchor the covering to the mattress, fail to hold down the corners of the covering. As a result, the corner seam of the cover can slide upwards, creating an unsightly appearance due to "peaking", where the corner seam sticks up above the surface of the sheet. The upper surface of the covering may then no longer lie flat. Furthermore, particularly in the case of a thin mattress, the corners of the cover can come entirely free of the mattress even as the diagonal elastic strips hold the rest of the cover in place.

One proposed solution is the "triangle" bed sheet strap, a set of three elastic straps extending at 120° angles from a central ring. Two of the straps are clipped into place to jointly serve as a diagonal elastic, while the third is clipped to the corner of the fitted sheet, pulling it inward. However, detaching and re-attaching twelve individual clips when changing sheets is an inconvenient task. A comparable solution is disclosed in U.S. Pat. No. 4,662,013, where an added elastic band serves the same purpose. While these modifications serve to prevent the cover corner from coming free of the mattress, the problem of "peaking" remains.

A need therefore exists for fitted coverings which do not require a complex installation process, which cling to mattresses of variable thickness, and which provide a neat appearance when installed on a mattress.

SUMMARY OF THE INVENTION

The invention provides a fitted mattress cover comprising conventional upper, end, side, and lower portions or panels. The covering incorporates, in the four corners of the lower panel, elastic elements installed diagonally between adjacent end and side panels.

Four additional elastic elements are disposed at the four corners of the cover, each extending perpendicularly from the midpoint of the diagonal elastic elements and along the seam between the end and side panels at that corner. The corner elastic elements thus reach around the lower side of the mattress and run upward toward the upper panel of the cover, terminating at some point along the seam. The diagonal and perpendicular corner elastic elements cooperate to hold the corners of the cover tightly to the mattress, and also provide a downward force on the corner seams, preventing the upper corners from peaking. The invention further comprises one or more elbow elastic elements disposed at the four corners of the cover, affixed to the cover, perpendicular to, and extending to either side of, the corner or perpendicular elastic elements.

DETAILED DESCRIPTION OF THE INVENTION

As used herein, the term "mattress cover" can refer to a sheet, mattress pad, blanket, coverlet, water-proof covering, allergen-proof covering, or other fabric or plastic covering intended to be fitted over a mattress. The cover can be made of any of the woven and nonwoven materials employed in the making of bedding, including but not limited to cotton, linen, flannel, satin, sateen, and the like. As is known in the art, waterproof sheeting materials such as polyvinyl chloride and nonwoven polyester can be employed in specific applications. The terms "elastic" and "elastic band" are used interchangeably.

U.S. Pat. Nos. 5,479,664, 5,513,403, 6,983,500, 7,316,039 and 8,438,679 are each incorporated herein by reference in their entireties, and for all purposes.

Broadly, the invention provides a fitted cover for a rectangular mattress having a sleeping surface and an opposite lower surface, the cover comprising an upper panel substantially co-extensive with the sleeping surface, two side panels disposed on opposite sides of the upper surface, and two end panels disposed on opposite ends of the upper surface. An annular lower panel may optionally be present. The upper, side and end panels define an open-sided rectangular box which is fittable onto the mattress. The cover further comprises, at each corner, a diagonal elastic band attached to an edge of a side panel and to an edge of the adjacent end panel and a corner elastic band attached to the center of the diagonal elastic band. The corner elastic extends perpendicularly from the diagonal elastic and along a seam between the side panel and the adjacent end panel, and is attached to the side and end panels along the seam.

An optional peripheral elastic band may be attached to the full lengths of the lower edges of the side panels and end panels, or to the full length of the inner edge of the lower panel if a lower panel is present. In alternative embodiments, there is no peripheral elastic band in the corners, on the portions of the lower edges that are subtended by the diagonal elastic.

Figure 1:
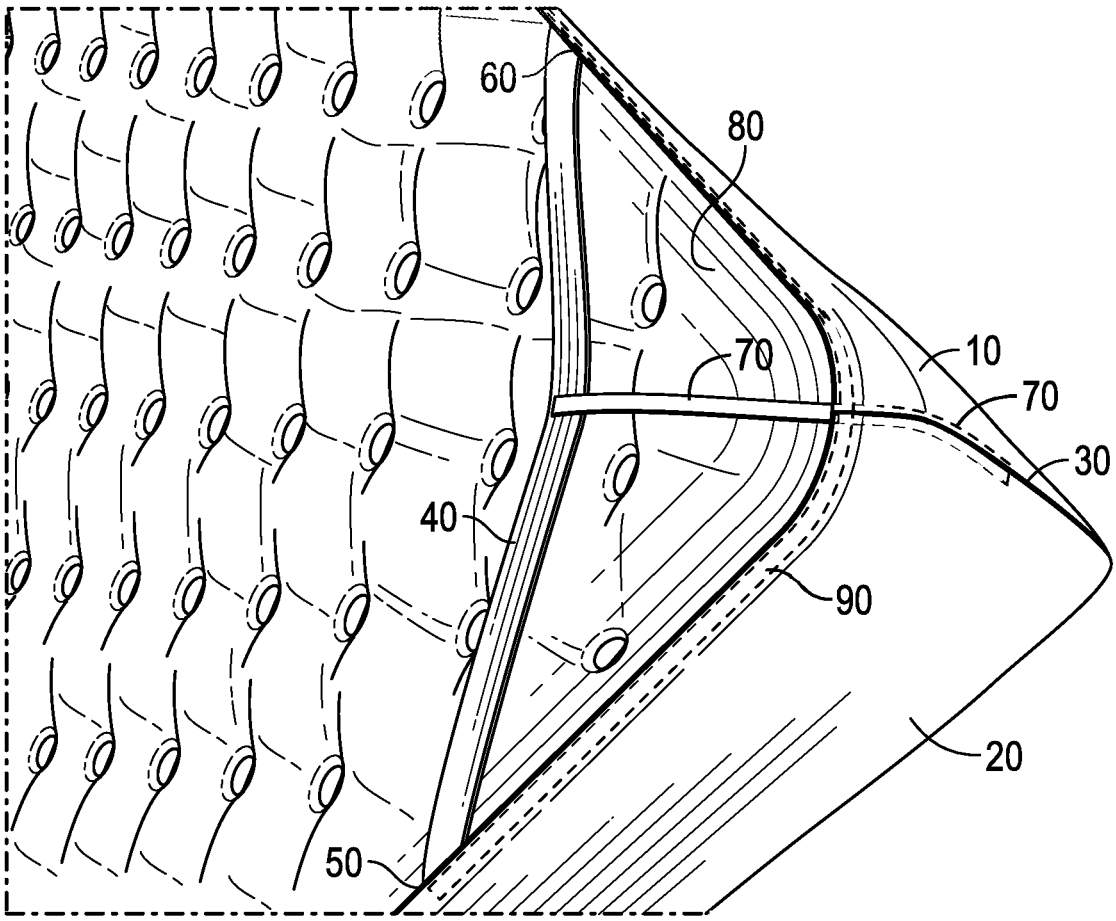
FIG. 1 is a perspective view of the lower side of one corner of a mattress fitted with a cover of the invention.

Turning to FIG. 1, an embodiment of the invention is illustrated. A fitted mattress cover comprises an upper panel (not shown), end panels 10, and side panels 20. A lower panel, not shown, may optionally be present. The upper, end and side panels are sized so as to cover the upper surface and substantially or completely cover the sides of a mattress 80. A lower panel, if present, covers only the periphery of the underside of the mattress, and is not shown in the illustrated embodiment. The upper panel, side panels and end panels may be separate pieces of fabric sewn together, but preferably are formed from a single, integral piece of fabric, which has been cut, folded, and sewn into a rectangular box-shaped cover as is known in the art. The cover incorporates at least two different types of sewn-in or sewn-on elastic elements.

The first type of elastic element is the diagonal elastic 40. Four such elements are disposed at the four corners of the cover, installed diagonally between and attached to adjacent edges 50 and 60 of the side and end panels, respectively. The diagonal elastic 40 is preferably attached to edges 50 and 60 by stitching or other known means. The diagonal elastic acts as a lock system and prevents the movement or shift of the fitted sheet during any pull from the top side of the fitted sheet.

The second type of elastic element is the corner or perpendicular elastic 70, four of which are disposed at the four corners of the cover. Each corner elastic 70 extends perpendicularly from the midpoint of a diagonal elastic 40, and continues along the seam 30 between the end and side panels at that corner. Thus, when the cover is installed on a mattress, the corner elastic 70 extends past the lower edge of the mattress and runs upward toward the upper panel of the cover. The corner elastic 70 may terminate at any point along the seam 30; but preferably extends between about ⅓ and about ⅔ of the length of the seam. More preferably, the corner elastic extends to within about 6 inches of the upper panel or top of the corner. The corner or perpendicular elastic lends a better grip and provides a snug look at all the four corners. The diagonal elastic 40 and the corner elastic 70 may be of any suitable dimensions. They may be of same width or different width, for example, 25 mm, 11 mm etc.

A third type of elastic element, a peripheral elastic 90, may be present. The peripheral elastic, if present, is disposed along the edges of the end panels 10 and side panels 20. If a lower panel is present, the peripheral elastic element will be disposed around the inner edges of the lower panel. Peripheral elastic 90 may be sewn onto the edges, or, as shown in FIG. 1, it may be sewn into a hem that runs along the edges. The peripheral elastic serves to pull the edges inward toward the center of the mattress.

Figure 2:
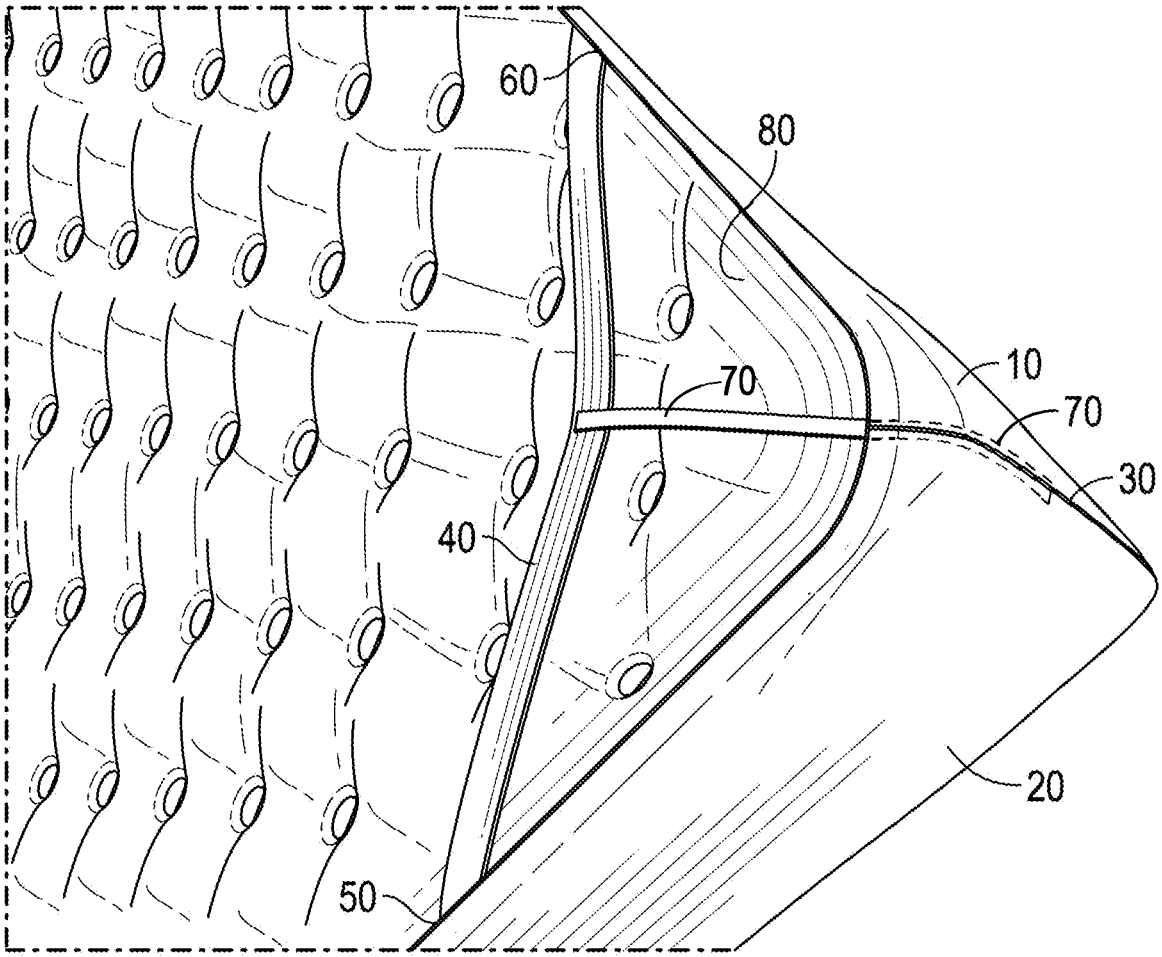
FIG. 2 is an alternative embodiment of the device shown in FIG. 1.

In another embodiment of the invention, shown in FIG. 2, the structure shown in FIG. 1 is retained, but the peripheral elastic 90 is omitted.

Figure 3:
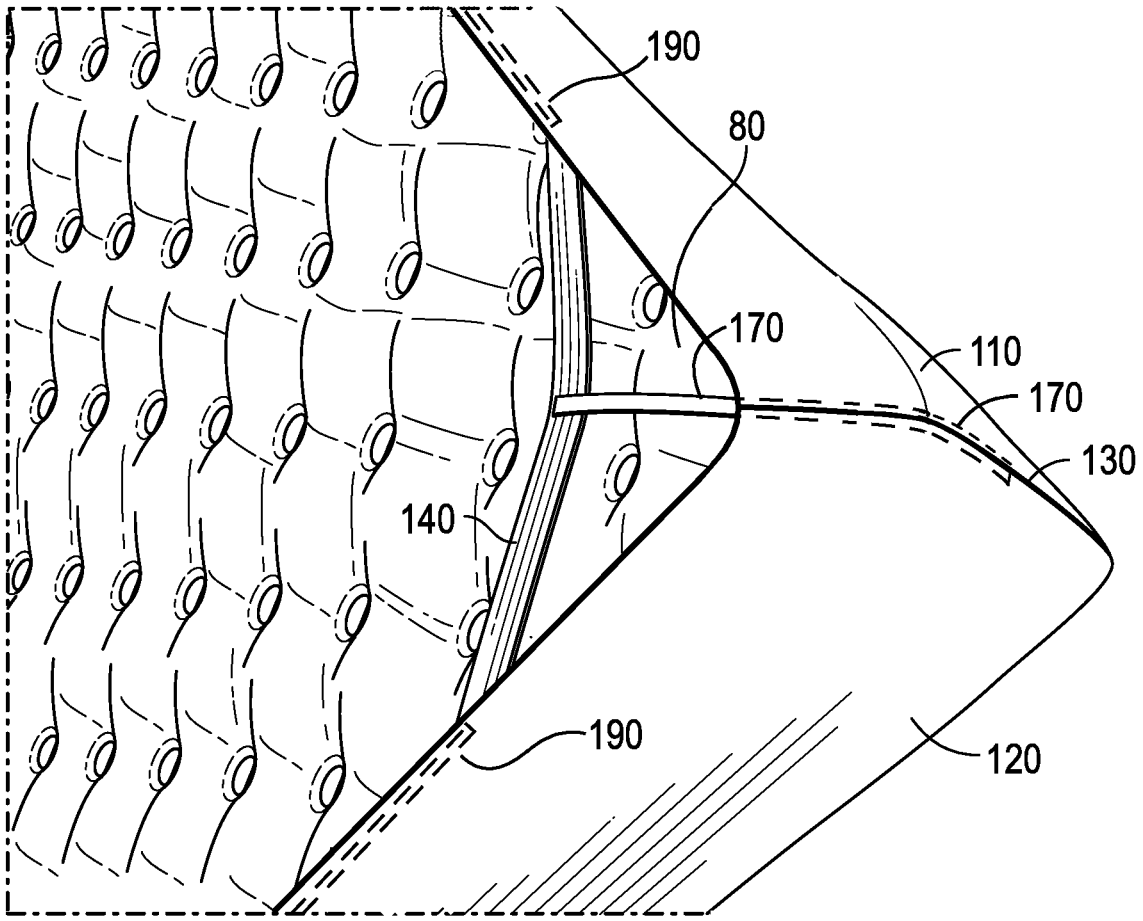
FIG. 3 is yet another embodiment of the device shown in FIG. 1.

In yet another embodiment of the invention, shown in FIG. 3, the four corners are free of peripheral elastic in the region subtended by diagonal elastic 140. The absence of the elastic on the four corners provides a clean look and prevents formation of wrinkles which are normally visible when elastic is used at the corner edges. It also avoids the high stress and strain on the fabric by the elastic and enhances the life of the fitted sheet. In this embodiment, a peripheral elastic 190 is present along the straight edges of the side and end panels, i.e., in those regions that are not subtended by the diagonal elastic 140. The peripheral elastic may be sewn to the panels along the edges, or may be sewn into a hem along the edge, as shown. A corner or perpendicular elastic 170 extends perpendicularly from the midpoint of the diagonal elastic 140, and continues along the seam 130 between the end and side panels 110 and 120 at that corner, in the same manner as described in FIG. 1.

Figure 4:
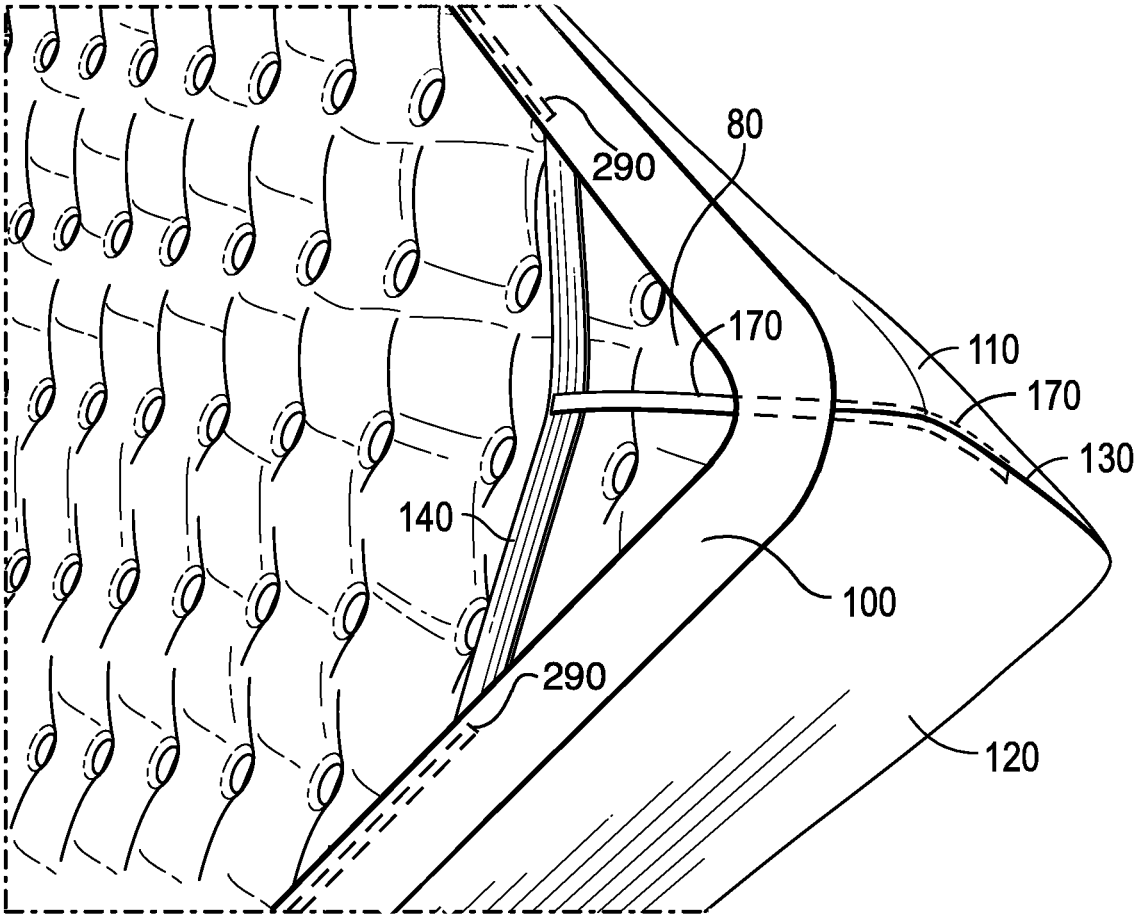
FIG. 4 is a perspective view of an alternative embodiment in which a lower panel is employed.

Turning now to FIG. 4, an embodiment is illustrated in which the cover has an annular lower panel 100. The lower panel covers the periphery of the underside of the mattress 80, and can have any annular width compatible with the need to insert the mattress into the cover. The lower panel may be a separate, sewn-on element, as shown in FIG. 4, or it may be formed by extending the end and side panels 110 and 120. In the illustrated embodiment, a peripheral elastic element 290 is disposed along the inner edges of the lower panel, but omitted at the four corners as shown. The peripheral elastic may be sewn to the lower panel along the edges, or may be sewn into a hem along the edges, as shown. Alternatively, the peripheral elastic element may extend around the entire periphery of the panels 110 and 120; in other embodiments the peripheral elastic element may be omitted. In yet another alternative embodiment, panel 100 may itself be an elastic fabric, effectively serving as both a lower panel and as a peripheral elastic element.

The diagonal elastic 140 is disposed at the four corners of the cover, installed diagonally across the corners of the lower panel 100. The corner or perpendicular elastic 170 extends perpendicularly from the midpoint of diagonal elastic 140, and continues beneath the lower panel and along the seam 130. As in the embodiment without a lower panel, when this cover is installed on a mattress, the corner elastic 170 extends past the lower edge of the mattress and runs upward toward the upper panel of the cover. The corner elastic 170 may terminate at any point along the seam 130; but again, it preferably extends between about ⅓ and about ⅔ of the length of the seam, and more preferably extends to within about 6 inches of the upper panel.

The corner or perpendicular elastic 70 (or 170) pulls the corner of the upper panel downward with sufficient force to hold the corner of the top panel against the top of the mattress. The corner elastic, in cooperation with the diagonal elastic to which it is attached, also exerts an inward force parallel to the lower surface of the mattress, which causes the fitted cover to cling snugly to the mattress. The combination of these two forces holds the cover close to the mattress, even if there is a mismatch between the height of the side and end panels of the cover and the thickness of the mattress. The elastic bands of the present invention thus allow the fitted sheet to fit mattresses of various thicknesses.

Figure 5:
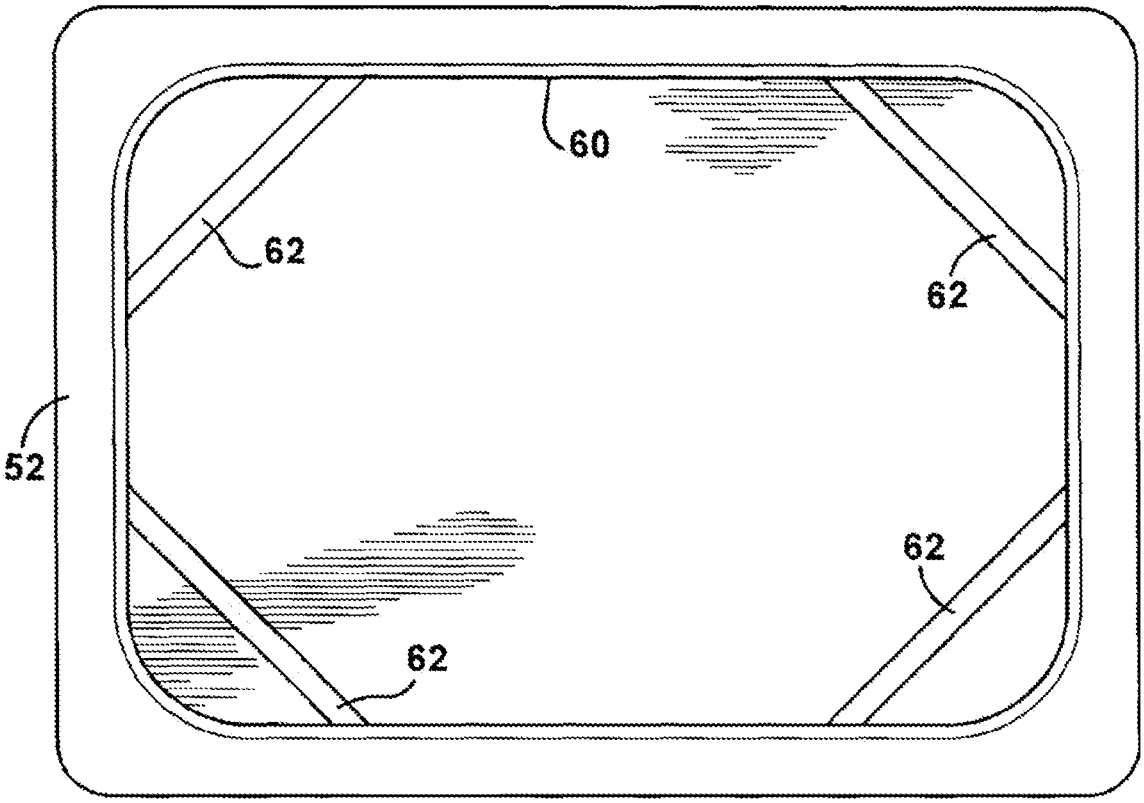
PRIOR ART FIG. 5
FIG. 5 is a bottom view of a prior art fitted sheet, showing a bottom panel with peripheral and diagonal elastic elements.

FIG. 5 shows a representative prior art fitted cover in a bottom view, from U.S. Pat. No. 8,438,679. The cover incorporates a bottom panel 52, diagonal elastic elements 62, and a peripheral elastic element 60. Accordingly, fitted sheets having both panels and elastic elements, as well as suitable materials for their construction and methods of incorporating these elements into fitted mattress coverings, are known in the art. (See, for example, incorporated U.S. Pat. Nos. 5,513,403 and 7,316,039 and the references therein). All such materials and methods are contemplated to be workable with the present invention, and are intended to be within the scope of the invention and the appended claims.

Figure 6:
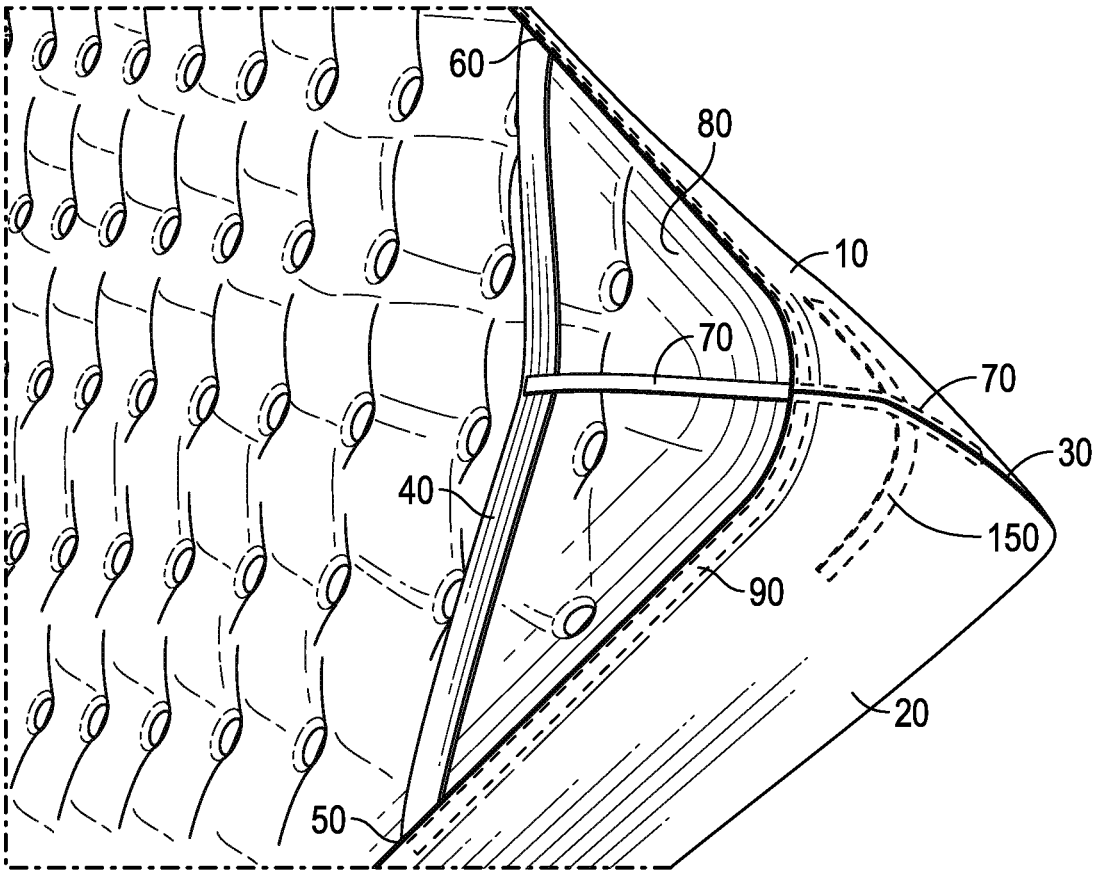
FIG. 6 is a perspective view of the lower side of one corner of a mattress fitted with a cover of the invention, according to an alternative embodiment of the invention.

FIG. 6 shows another embodiment of the invention where the structure shown in FIG. 1 is retained and a fourth type of elastic element, first elbow elastic 150, is disposed at each of the four corners of the cover. Each first elbow elastic 150 extends to either side of, and perpendicular to, the corner elastic elements 70. The first elbow elastic 150 is disposed across and perpendicular to the seam 30 and may be approximately equidistant from the upper and lower panels of the cover. Alternatively, the first elbow elastic 150 may be off-center between the upper and lower panels of the cover. The first elbow elastic 150 runs parallel to the outer edge of the upper panel. Preferably, the first elbow elastic 150 extends equally on either side of the seam 30. First elbow elastic 150 may be sewn on the outside of the mattress cover, or, as shown in FIG. 6, it may be sewn on the inside of the cover.

The corner elastic 70 provides a tension between the periphery and the upper corner of the sheet resulting in a force holding the corner down and reducing slippage of the sheet. The tension provided by the extended portion of the corner elastic 70, extending upward past the lower edge of the mattress, serves to pull the upper corner of the sheet downward, so as to prevent or reduce unsightly peaking of the corner. The first elbow elastics 150 serve to hold the side panels tightly to the mattress, preventing slippage upward. As a result, the cover achieves a further snug fit and further reduces peaking of the corners.

Figure 7:
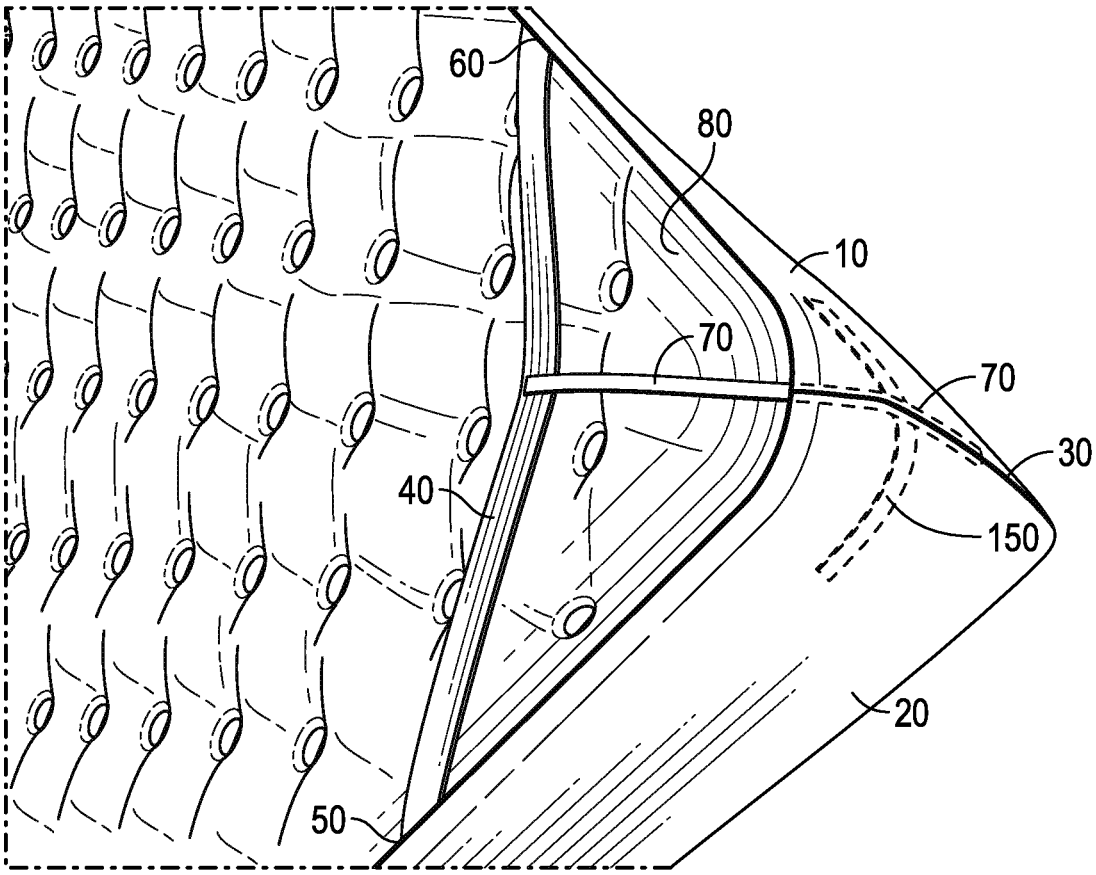
FIG. 7 is an alternative embodiment of the device shown in FIG. 6.

In another embodiment of the invention, shown in FIG. 7, the structure shown in FIG. 6 is retained, but the peripheral elastic 90 is omitted.

Figure 8:
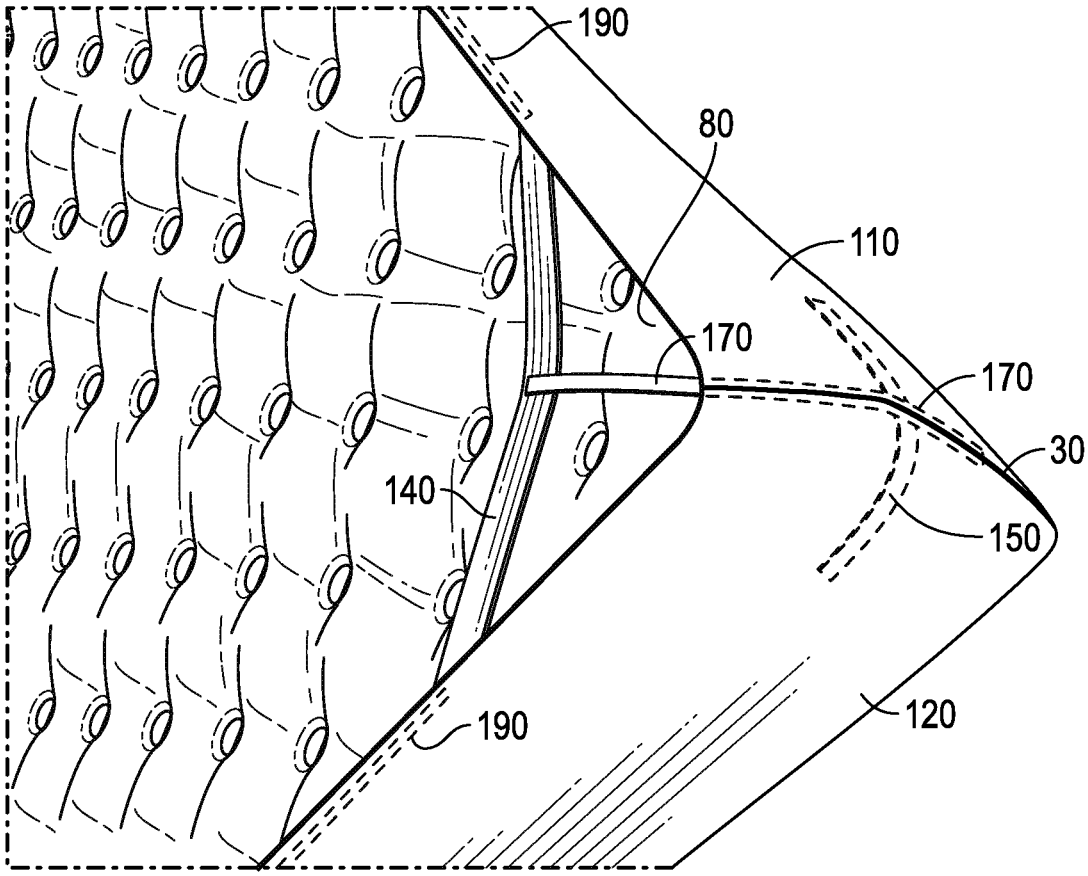
FIG. 8 is yet another embodiment of the device shown in FIG. 6.

In yet another embodiment of the invention, shown in FIG. 8, the four corners are free of peripheral elastic in the region subtended by diagonal elastic 140. The absence of the elastic on the four corners provides a clean look and prevents formation of wrinkles which are normally visible when elastic is used at the corner edges.

Figure 9:
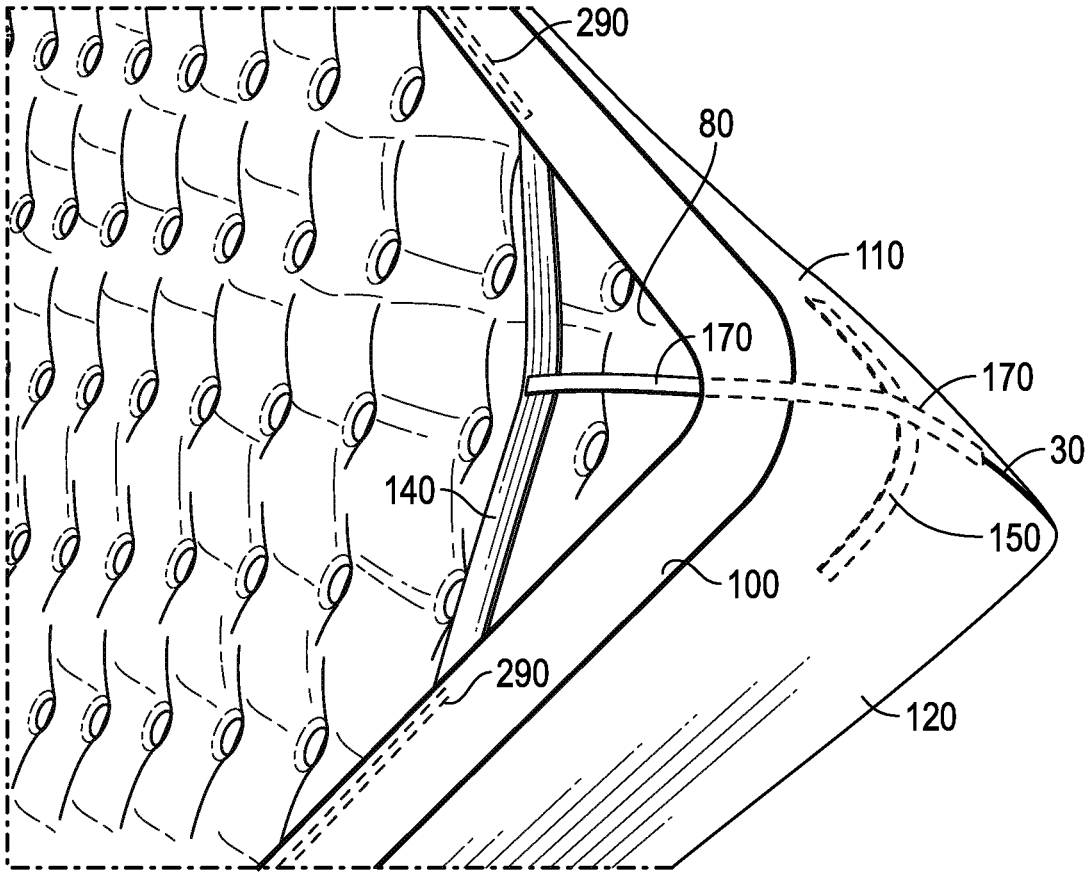
FIG. 9 is a perspective view of an alternative embodiment of the device shown in FIG. 6 in which a lower panel is employed.

Turning now to FIG. 9, an embodiment is illustrated in which the cover has an annular lower panel 100 that covers the periphery of the underside of the mattress 80.

Figure 10:
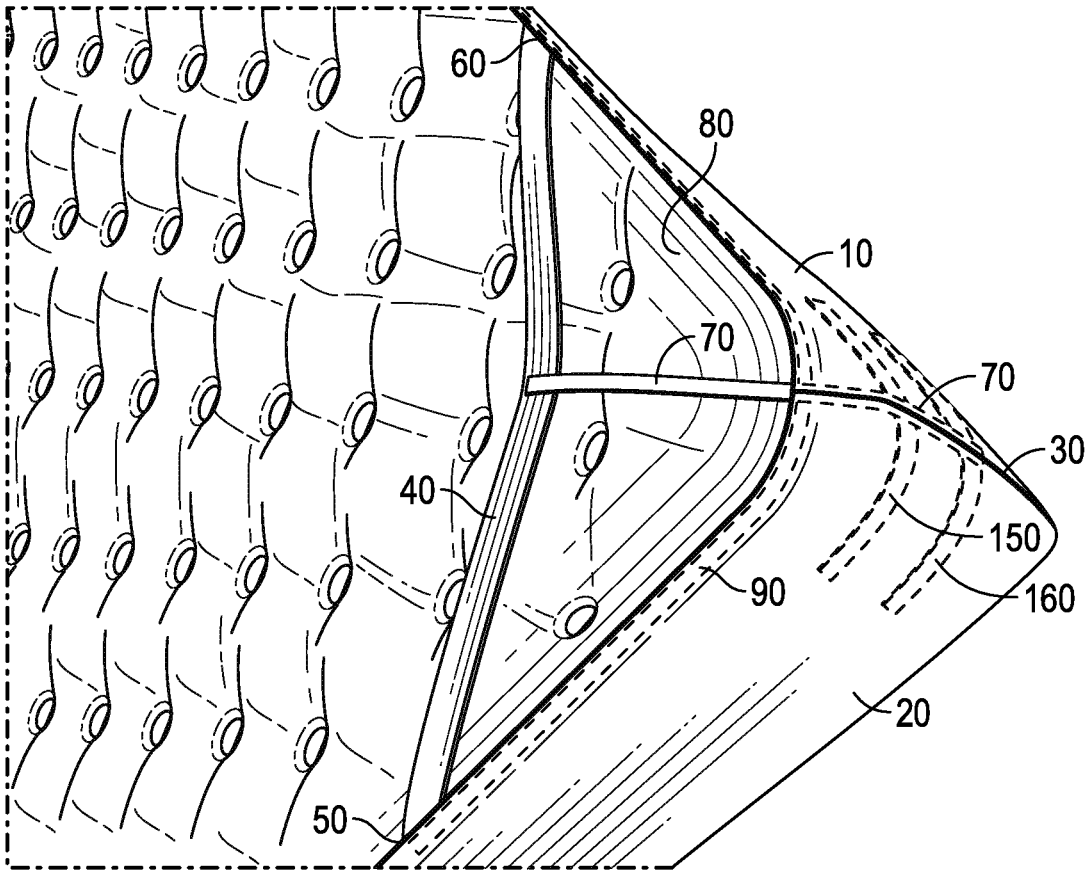
FIG. 10 is a perspective view of the lower side of one corner of a mattress fitted with a cover of the invention, according to yet another embodiment of the invention.

FIG. 10 shows an additional embodiment of the invention where the structure shown in FIG. 6 is retained and a second elbow elastic element 160 is disposed at each of the four corners of the cover. Each second elbow elastic 160 extends to either side of, and perpendicular to, the corner elastic 70. Thus, there are eight elbow elastic elements in this embodiment—four first elbow elastics 150 and four second elbow elastics 160. Optionally, there could be yet another set of third elbow elastics. The second elbow elastic 160 is disposed across and perpendicular to the seam 30 and parallel to first elbow elastic 150. The elbow elastics 150 and 160 are preferably disposed to be approximately equidistant between the upper and lower panels of the cover. The second elbow elastic 160 may be off-center between the upper and lower panels of the cover. The second elbow elastic 160 runs parallel to the outer edge of the upper panel, or the peripheral elastic 90 if present. Preferably, the second elbow elastic 160 extends equally on either side of the seam 30. Second elbow elastic 160 may be sewn on the outside of the mattress cover, or, as shown in FIG. 10, it may be sewn on the inside of the cover.

Like the first elbow elastic 150, the second elbow elastic 160 serves to provide a further snug fit of the mattress cover and a further reduction in peaking.

Figure 11:
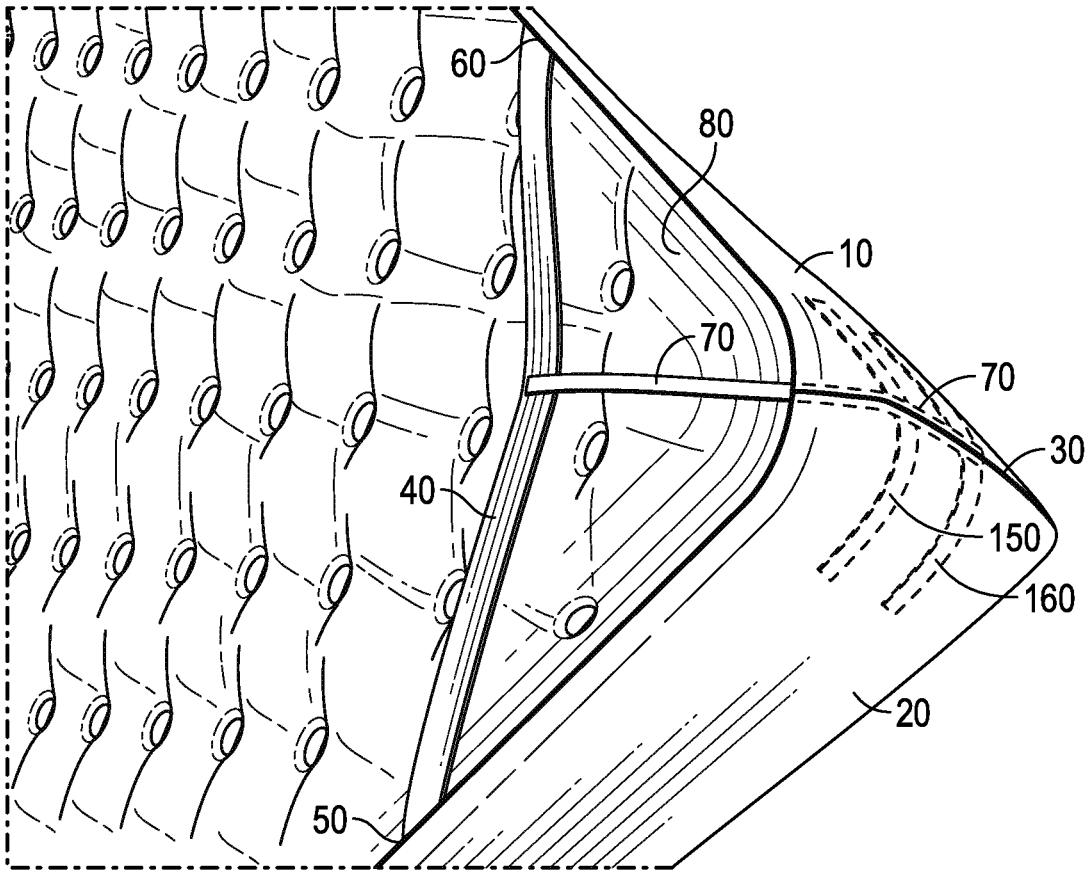
FIG. 11 is an alternative embodiment of the device shown in FIG. 10.

In another embodiment of the invention, shown in FIG. 11, the structure shown in FIG. 10 is retained, but the peripheral elastic 90 is omitted.

Figure 12:
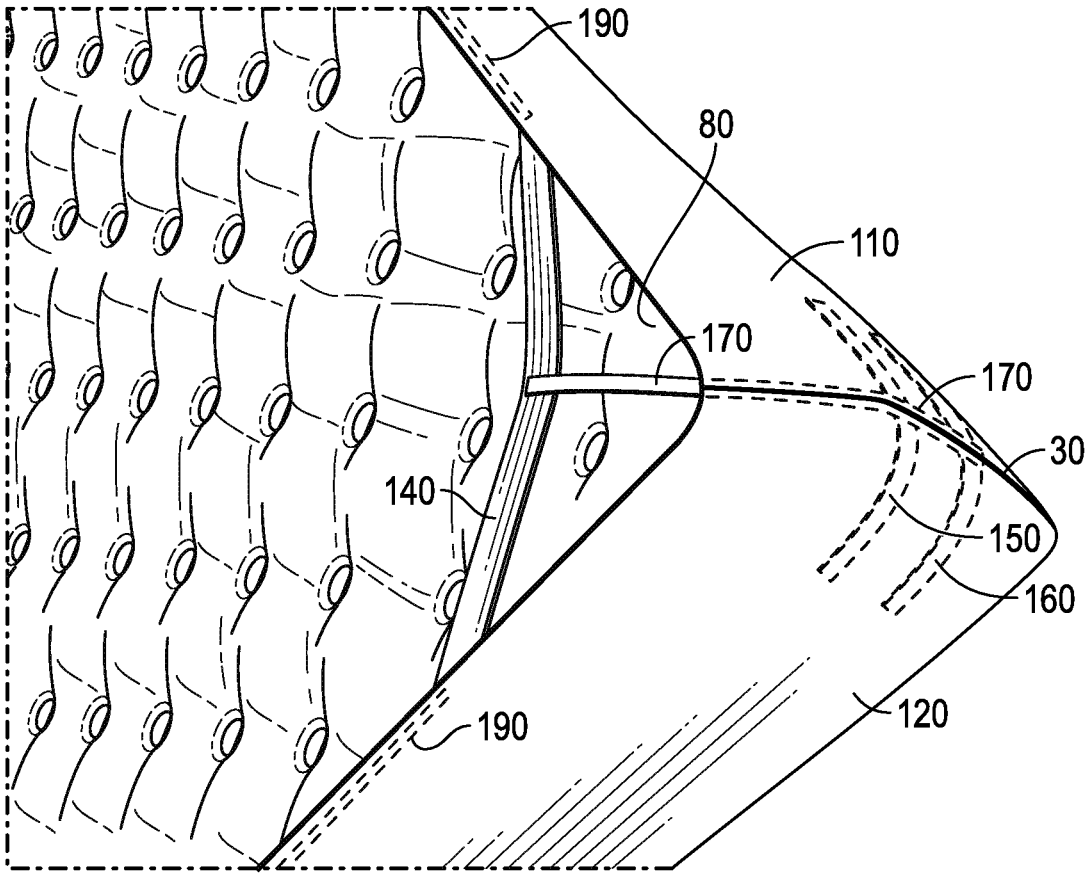
FIG. 12 is yet another embodiment of the device shown in FIG. 10.

In yet another embodiment of the invention, shown in FIG. 12, the four corners are free of peripheral elastic in the region subtended by diagonal elastic 140.

Figure 13:
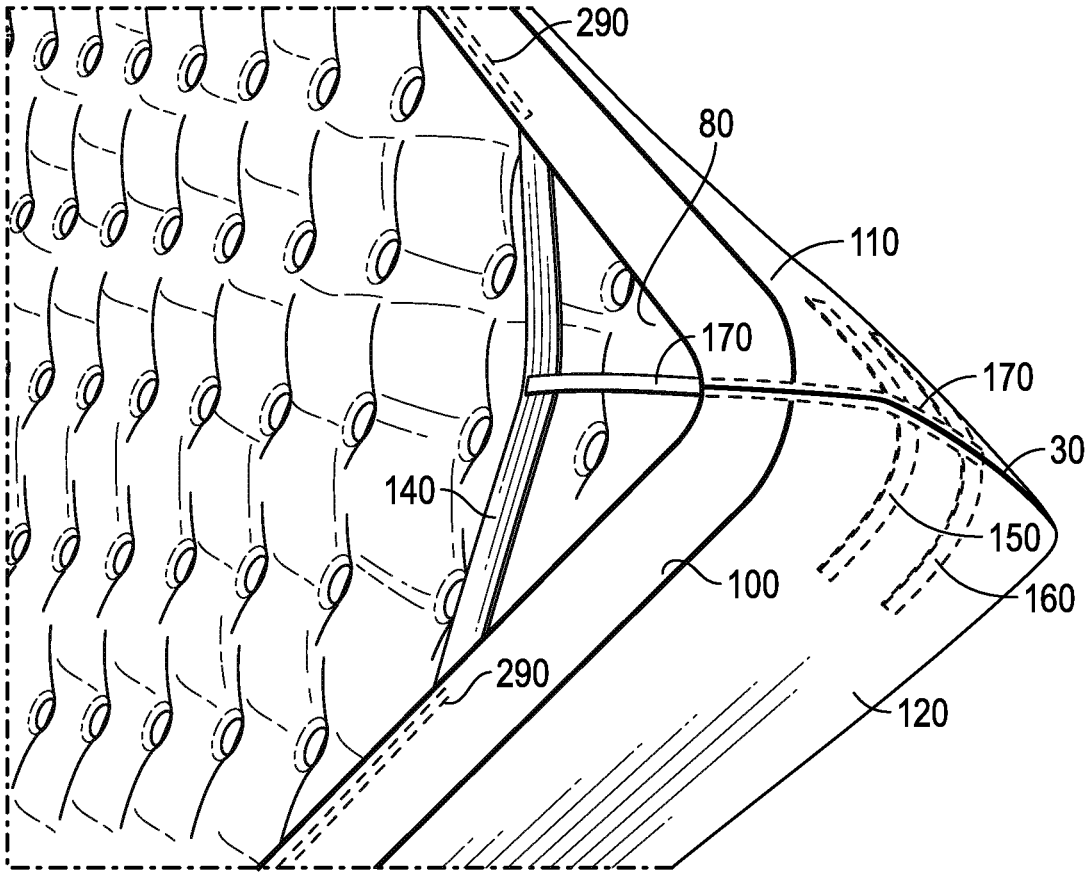
FIG. 13 is a perspective view of an alternative embodiment of the device shown in FIG. 10 in which a lower panel is employed.

In FIG. 13, an embodiment is illustrated in which the cover has an annular lower panel 100 that covers the periphery of the underside of the mattress 80. While various features are presented in this description and in the drawings, it should be understood that these features may be used singly or in various combinations. It should also be understood that the examples described herein and illustrated in the drawings are intended to be exemplary, and are not intended to limit or define the invention. Accordingly, variations and modifications will be apparent to those skilled in the art, and the present disclosure will enable those skilled in the art to make and use alternative designs having alternative elements that correspond to elements recited in the claims. Such modifications and variations are intended to be within the scope of the invention, the scope of which is established only by the appended claims.

We claim:

1. A fitted cover for a rectangular mattress having a sleeping surface and an opposite lower surface, the cover comprising:

an upper panel substantially co-extensive with the sleeping surface;

two side panels disposed on opposite sides of the upper surface; and two end panels disposed adjacent to said side panels, on opposite ends of the upper surface;

wherein the upper, side and end panels define the fitted cover which is fittable onto the mattress; the fitted cover further comprising, at each corner, a diagonal elastic band attached to an edge of one of said side panels and to an edge of the adjacent end panel;

at each corner, a corner elastic band attached to the center of the diagonal elastic band, extending perpendicularly therefrom and extending along at least about ⅓ of the length of a seam between the side panel and the adjacent end panel;

wherein the corner elastic band is attached to the side and end panels along said seam.

2. The fitted cover according to claim 1, wherein the corner elastic band extends between about ⅓ and about ⅔ of the length of the seam.

3. The fitted cover according to claim 1, wherein the corner elastic band extends to within about 6 inches of the upper panel.

4. The fitted cover according to claim 1, further comprising a lower panel.

5. The fitted cover according to claim 3, further comprising a lower panel.

6. The fitted cover according to claim 1, further comprising a peripheral elastic band attached to the full lengths of the lower edges of the side panels and the end panels except at the four corners.

7. The fitted cover according to claim 2, further comprising a peripheral elastic band attached to the full lengths of the lower edges of the side panels and the end panels except at the four corners.

8. The fitted cover according to claim 3, further comprising a peripheral elastic band attached to the full lengths of the lower edges of the side panels and the end panels except at the four corners.

9. The fitted cover according to claim 4, further comprising a peripheral elastic band attached to the full length of the inner edge of the lower panel except at the four corners.

10. The fitted cover according to claim 5, further comprising a peripheral elastic band attached to the full length of the inner edge of the lower panel except at the four corners.

11. The fitted cover according to claim 1, further comprising a peripheral elastic band attached to the full lengths of the lower edges of the side panels and the end panels.

12. The fitted cover according to claim 2, further comprising a peripheral elastic band attached to the full lengths of the lower edges of the side panels and the end panels.

13. The fitted cover according to claim 3, further comprising a peripheral elastic band attached to the full lengths of the lower edges of the side panels and the end panels.

14. The fitted cover according to claim 4, further comprising a peripheral elastic band attached to the full length of the inner edge of the lower panel.

15. The fitted cover according to claim 5, further comprising a peripheral elastic band attached to the full length of the inner edge of the lower panel.

16. A fitted cover for a rectangular mattress having a sleeping surface and an opposite lower surface, the cover comprising:

an upper panel substantially co-extensive with the sleeping surface;

two side panels disposed on opposite sides of the upper surface; and two end panels disposed adjacent to said side panels, on opposite ends of the upper surface;

wherein the upper, side and end panels define the fitted cover which is fittable onto the mattress; the fitted cover further comprising, at each corner, a diagonal elastic band attached to an edge of one of said side panels and to an edge of the adjacent end panel; at each corner, a corner elastic band attached to the center of the diagonal elastic band, extending perpendicularly therefrom and extending along at least about ⅓ of the length of a seam between the side panel and the adjacent end panel;

wherein the corner elastic band is attached to the side and end panels along said seam; further comprising one or more elbow elastic bands disposed at each of the four corners of the cover, affixed to the cover, perpendicular to, and extending to either side of, the corner elastic bands.

17. The fitted cover according to claim 16, wherein the one or more elbow elastic bands comprise:

a first elbow elastic extending to either side of, and perpendicular to, the corner elastic band; and a second elbow elastic extending to either side of, and perpendicular to, the corner elastic band.

18. The fitted cover according to claim 17, wherein the second elbow elastic is parallel to the first elbow elastic.

19. The fitted cover according to claim 16, further comprising a peripheral elastic band attached to the full lengths of the lower edges of the side panels and the end panels.

20. The fitted cover according to claim 16, further comprising a peripheral elastic band attached to the full lengths of the lower edges of the side panels and the end panels except at the four corners.

* * * * *